United States Patent [19]

Daussan et al.

[11] Patent Number: 4,908,234

[45] Date of Patent: Mar. 13, 1990

[54] METHOD AND INSTALLATION FOR SPRAYING A MULTI-LAYER INSULATING REFRACTORY COATING, AND THE COATING THUS OBTAINED

[75] Inventors: Jean-Charles Daussan, Metz; Gërard Daussan; Andre Daussan, both of Longeville-Les-Metz, all of France

[73] Assignee: Daussan et Compagnie, Woippy, France

[21] Appl. No.: 174,908

[22] Filed: Mar. 29, 1988

[30] Foreign Application Priority Data

Apr. 3, 1987 [FR] France ..... 87 04694
Aug. 12, 1987 [FR] France ..... 87 11466

[51] Int. Cl.[4] ..... B05D 7/22; B05B 13/06
[52] U.S. Cl. ..... 427/236; 118/317
[58] Field of Search ..... 427/236, 427; 118/317, 118/300; 366/181

[56] References Cited

U.S. PATENT DOCUMENTS 3,233,580 2/1966 Levake ..... 118/317
4,120,260 10/1978 Kubo et al. ..... 118/317
4,443,109 4/1984 Watts ..... 366/134
4,695,167 9/1987 Mori et al. ..... 366/181

FOREIGN PATENT DOCUMENTS 0123758 11/1984 European Pat. Off. .
0170322 2/1986 European Pat. Off. .

OTHER PUBLICATIONS

"Die Warmbetonherstellung", *Betonwerk & Fertigteil-Technik*, vol. 38, No. 7, Jul. 1972, by N. Brolich, pp. 532–538.

*Primary Examiner*—Janyce Bell
*Attorney, Agent, or Firm*—Young & Thompson

[57] ABSTRACT

A method and installation for applying an insulating refractory coating comprising at least two layers of equal of unequal thickness, of different compositions and equal or different water contents, onto surfaces such as the interior of metallurgical vessel (1). At least two aqueous pasty hardenable products are successively applied to the surfaces. In the case of each layer of different material, the corresponding products, which are pulverulent and/or fibrous, are successively supplied, continuously or discontinuously, through a single means (10) for spraying the surface to be coated.

25 Claims, 9 Drawing Sheets

METHOD AND INSTALLATION FOR SPRAYING A MULTI-LAYER INSULATING REFRACTORY COATING, AND THE COATING THUS OBTAINED

The invention relates to a method and installation for applying an insulating refractory coating made up of at least two layers of equal or unequal thickness, of different composition and different water contents, on to surfaces such as the interior of metallurgical vessels.

French Pat. No. 2 393 637 by the present Applicants discloses a method in which a hardenable aqueous pasty mixture containing inorganic particles, fibres if required, and an organic and/or inorganic binder is applied to the interior of a metallurgical vessel such as a casting tundish, by moulding, tamping or projecting by using a trowel or other instrument.

Also, French patent application No. 2 585 273 in the name of the present Applicants discloses a method in which at least two layers containing the aforementioned ingredients and pulverulent carbonaceous substances if required, are applied to the interior of the metallurgical vessel; the two layers, however, have different compositions.

The first layer adjacent the refractory permanent lining of the metallurgical vessel is not or is only partially sinterable at the temperature of the liquid metal cast in the vessel, and consequently the layer is pulverulent at the end of the casting operation and does not adhere to the vessel wall.

The second layer, which is in direct contact with the liquid metal, is sintered to a greater extent, and thus has mechanical cohesion during the entire stay of the liquid metal inside the metallurgical vessel.

German patent application No. 35 37 729 also discloses a spray device comprising a hopper in which a liquid binder is discontinuously mixed with a refractory charge in order to prepare an oily mixture which is conveyed by a pump towards a spraying lance.

In the case of the last-mentioned device, an additional refractory material is injected from a pressure vessel upstream of the spraying lance and mixed with the aforementioned oily mixture. The device can therefore be used to spray a refractory coating on to the interior of a metallurgical vessel.

The main disadvantage of this device is that firstly it considerably increases the weight and complexity of the spray lance mechanism and secondly the final product is less uniform since a pasty product and a pulverulent product are injected simultaneously into the lance head.

Consequently, spraying has to be frequently interrupted, so that it is not always possible to obtain a continuous coating of uniform composition covering the entire inner surface of a metallurgical vessel without joins.

Furthermore, in a first operation the device produces an oily premixture containing only a part of the solid constituents and conveyed to the pre-mixer, the pump and the duct in front of the spray lance. This means that the complete device is difficult to maintain and has to be completely cleaned after each interruption, with the risk of solidification of binder in the ducts.

On the other hand, since the device comprises a binder-manufacturing station, it is usually impossible to inject various refractory materials upstream of the spraying lance, if they are incompatible with the binder.

Furthermore, since an additional refractory material is injected upstream of the spraying lance and added to the oily pre-mixture, it is impossible to obtain a completely homogeneous mixture and impossible to use the same lance to spray at least two oily premixtures and at least two additional refractory substances.

The aim of the invention is to provide a method and installation for obviating the disadvantages of the aforementioned known embodiment.

The invention relates to a method of applying an insulating refractory coating made up of at least two layers of equal or unequal thickness, different compositions and equal or different water contents, on to surfaces such as the interior of metallurgical vessels, at least two aqueous pasty hardenable products being successively applied to the surfaces by the method, characterised in that in the case of each layer of different material, the corresponding products, which are pulverulent and/or fibrous, successively supply, either continuously or discontinuously, a single means for spraying on to the surface to be coated.

According to a preferred embodiment of the invention, in the case of each layer, the set of solid constituents for forming the layer is successively introduced, continuously or discontinuously, into a tubular member containing a spiral conveyor after which the set of constituents is successively and continuously fed to a tubular member containing a spiral conveyor and/or mixing blades into which the necessary amount of water is continuously introduced by a water metering device in order to obtain the desired pasty consistency for each layer, the resulting pasty mixtures are then successively fed by gravity to a hopper or are fed via mixing blades in a hopper to a common single pump and/or mixing tank under pressure and are then successively fed by these propulsion means to a single pipe system at the end of which the various pasty mixtures are successively sprayed under pressure through the same lance on to the surface to be coated.

According to another feature, the invention relates to an installation for applying an insulating refractory coating comprising at least two layers of equal or unequal thickness, different compositions and equal or different water contents on to surfaces such as the interior of metallurgical vessels, at least two aqueous pasty hardenable products being successively applied to the surfaces by the installation, the installation being characterised in that it comprises two pairs of tubular members each containing a respective metering spiral conveyor and a mixing screw and/or blades, and means for supplying each pair of tubular members with the solid constituents of each layer to be formed, the second tubular members each comprising a water inlet connected to means for continuously supplying the tubular members with the quantity of water necessary to obtain the desired pasty consistency for each layer, means being provided whereby the mixture coming from the two tubular members in the first pair or the other two tubular members is fed to a pump connected to a single pipe system for spraying the mixture.

The method and installation according to the invention have the advantage of operating either continuously or discontinuously, since the solid constituents are continuously metered in the first tubular member containing the metering screw conveyor.

Water at an adjustable pressure and flow rate is continuously added in the second tubular member containing the mixing screw. Water can be added in a single tubular member used for metering and mixing, so that the pump and/or mixing tank under pressure continuously receives a mixture having the desired pasty consistency, thus obtaining optimum conditions for conveying the mixture through the spraying pipe system and adhesion of the mixture to the surface to be coated. The single tubular member for metering and mixing, by incorporating water as necessary, is hereinafter called by the short term "single tubular member".

After spraying stops, the installation contains only a relatively small quantity of pasty mixture capable of hardening.

The installation can be cleaned simply by sending water into the second tubular member or the single tubular member in order to remove any trace of pasty mixture capable of hardening from the member or the pump or mixing tank under pressure and the spraying pipe system.

Furthermore, since the method and installation operate continuously under perfectly controlled conditions, the sprayed mixture is perfectly homogeneous and reproducible from one operation to the next.

Furthermore, if one of the two pairs of spiral conveyors or one of the tubular members is stopped and the other pair of spiral conveyors or the other single tubular member is started, a pasty mixture of different composition can be fed to the pump and/or the pressurized mixing tank without interruption, using a single lance.

According to a preferred version of the invention, the two second tubular members are combined into a single substantially tubular second member comprising a water inlet and means for mixing the pasty aqueous mixtures, the two first tubular members are combined into a single first tubular member serving the hoppers and/or parts of hoppers containing the solid constituents of each layer to be formed, the single first tubular member comprising a metering and mixing spiral conveyor, and each hopper or part of a hopper containing the various solid constituents of each layer to be formed is equipped with means enabling or preventing the solid constituent therein from flowing.

This can simplify the installation and consequently reduce the cost of investment and maintenance while benefiting from the advantages provided by the other features of the invention.

The installation can thus uninterruptedly produce the two layers of different compositions described inter alia in French Pat. No. application No. 2 585 273 in the name of the present Applicants.

Other features and advantages of the invention will be clear from the following description.

In the accompanying drawings, given by way of non-limitative example:

Figure 1:
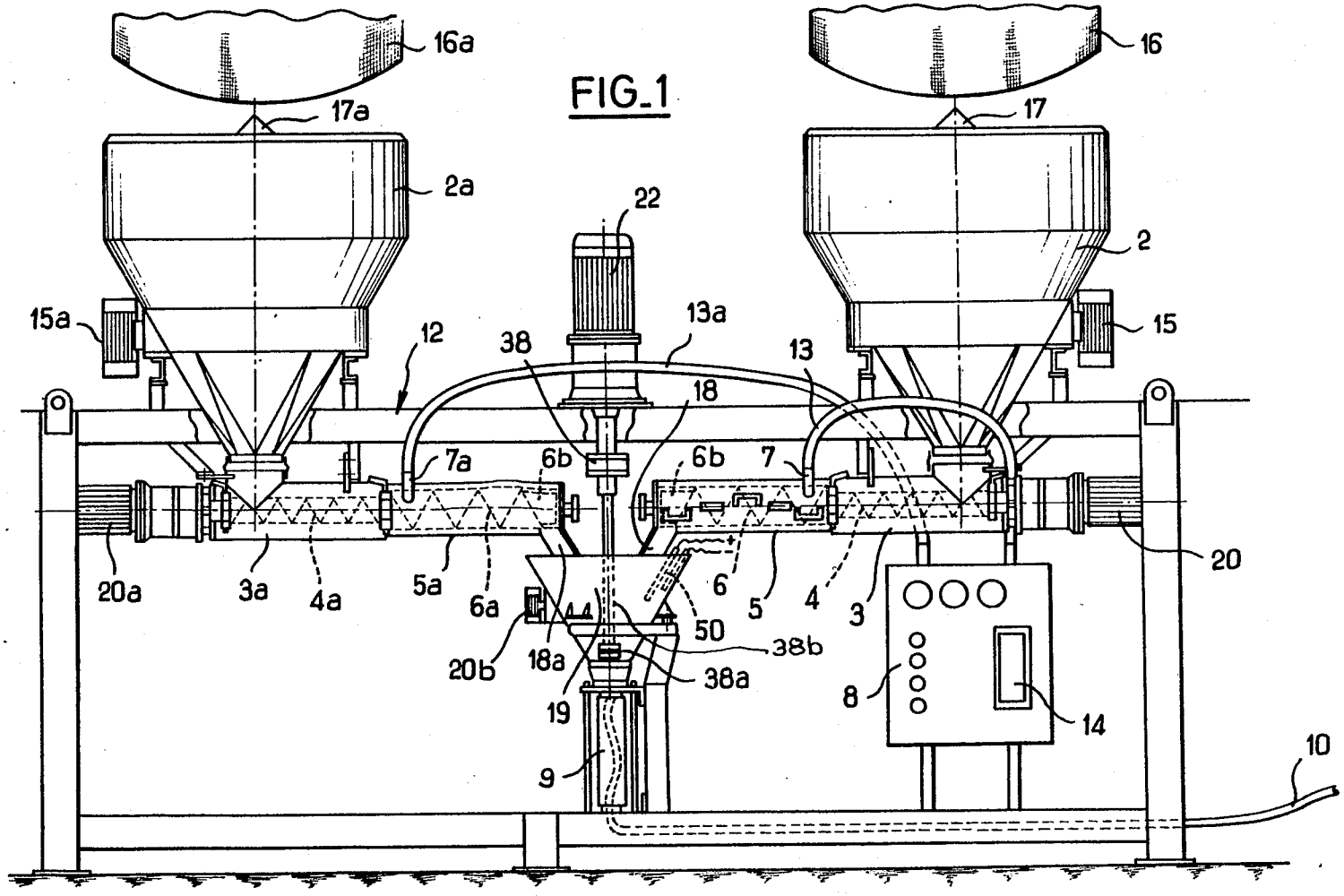
FIG. 1 is a view in elevation of an installation according to the invention.
Figure 4:
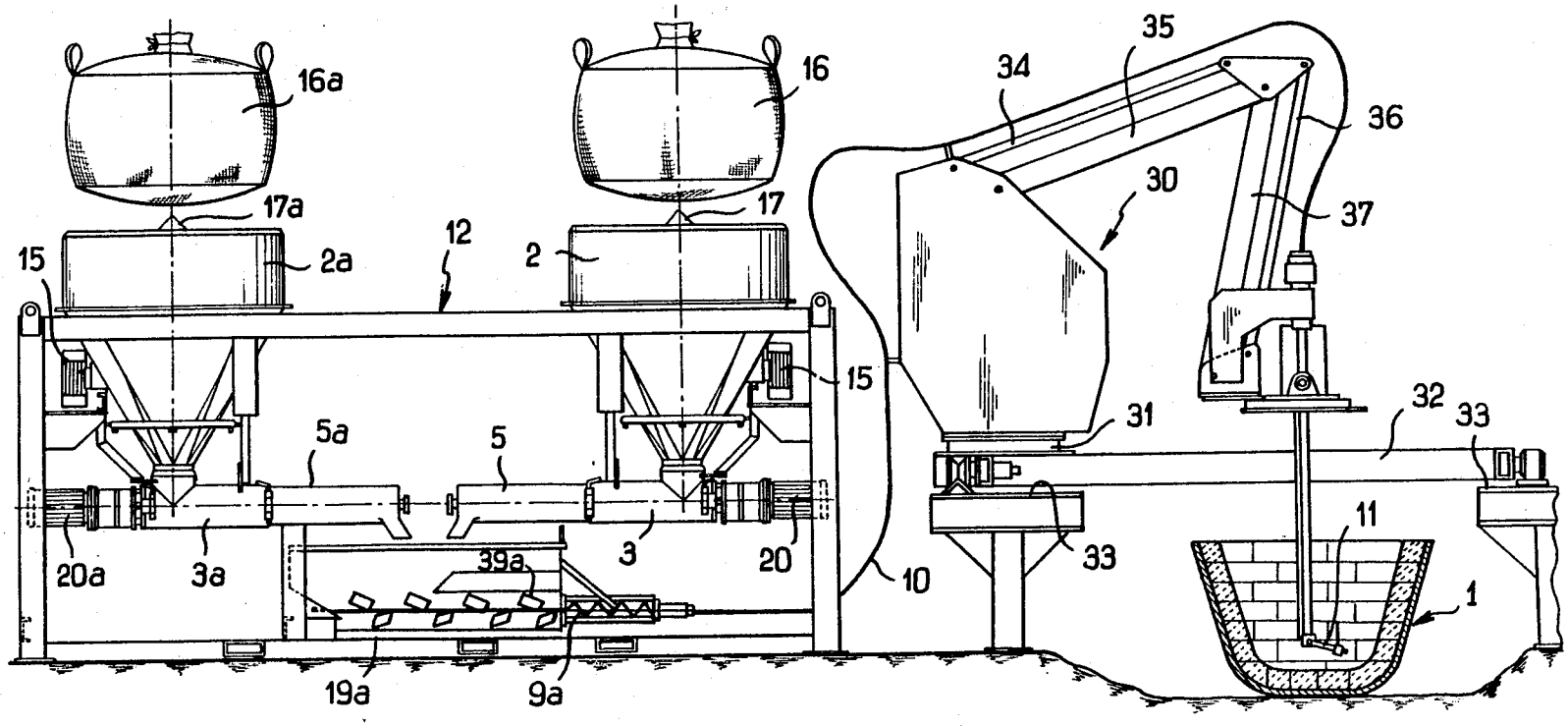
FIG. 4 is a view in elevation of a variant of the installation in FIG. 1 associated with a robot for spraying the coating on the inside of a tundish.

In the embodiment in FIG. 1, the installation is designed to apply an insulating refractory coating to the interior of a metallurgical vessel such as a casting tundish 1 (see FIG. 4). The coating is applied to the base and sides of tundish 1 in the form of an aqueous pasty mixture containing inorganic particles, fibres if required, an organic and/or inorganic binder if required, and pulverulent substances if required, as described e.g. in French Pat. No. 2 393 637 and French patent application No. 2 585 273 in the name of the Applicants.

The installation comprises means such as a hopper 2 for continuously or discontinuously introducing all the solid constituents of the aforementioned mixture into a first tubular member 3 in which a metering and mixing spiral conveyor 4 is mounted for rotation and opens into a second tubular member 5 in which a mixing spiral conveyor 6 is mounted for rotation. The second tubular member 5 has a water inlet 7 connected to a cabinet 8 containing means for continuously or discontinuously introducing water into the tubular member 5 in the quantity necessary for obtaining the desired pasty consistency for the mixture treated in the second tubular member 5. Means are also provided for sending the mixture towards a pump 9 for driving the mixture into a pipe system 10 ending in a lance 11 (see FIG. 4) for spraying the pasty mixture into the casting tundish 1.

In the example shown in FIG. 1, the installation comprises two other tubular members 3*a*, 5*a* symmetrically disposed with respect to tubular members 3 and 5 on a common frame 12. Members 3*a*, 5*a* comprise a mixing, metering spiral conveyor 4*a* and a mixing spiral conveyor 6*a*. Means are provided whereby the mixture coming from the first pair of tubular members 3, 5 or from the other two tubular members 3*a*, 5*a* is fed to the single pump 9 connected to the pipe system 10 for spraying the mixture.

The water inlets 7, 7*a* of tubular members 5, 5*a* which each comprise a mixing spiral conveyor 6, 6*a*, are connected to a cabinet 8 by pipe systems 13, 13*a*. Cabinet 8 comprises pressure-regulating means, a pressure-gauge and a flow meter 14.

Each tubular member 3, 3*a* comprising the metering and mixing spiral conveyor 4, 4*a* is surmounted by a hopper 2, 2*a* for introducing the solid constituents of the mixture which comprises means such as a vibrator 15, 15*a* for facilitating the flow of mixture in the tubular members.

The mixture of solid constituents is introduced e.g. into hoppers 2, 2*a* from plastic bags 16, 16*a* which are pierced on a cone 17, 17*a* provided in each hopper 2, 2*a*.

The end 18, 18*a* of each tubular member containing the mixing spiral conveyor opens above a single hopper 19 which can comprise level probes 15 and/or a timing mechanism for stopping the arrival of material or for introducing the pasty mixture into the pump. Hopper 19 is equipped with a vibrator 20*b*.

As also shown in FIG. 1, the two spiral conveyors 4, 6 and 4*a*, 6*a* are mounted on the same shaft and driven in rotation by the same motor 20, 20*a*.

Conveyor 6, 6a mounted in tubular member 5, 5a comprising water inlet 7, 7a can have a larger pitch and diameter than the conveyor 4, 4a mounted in the other tubular member 3, 3a and supplied with the solid constituents.

Alternatively, conveyor 6, 6a can be replaced by mixing blades, shown at 6b in FIG. 1, mounted on the shaft of conveyor 4, 4a and rotating around it inside the second tubular member 5, 5a.

Figure 2:
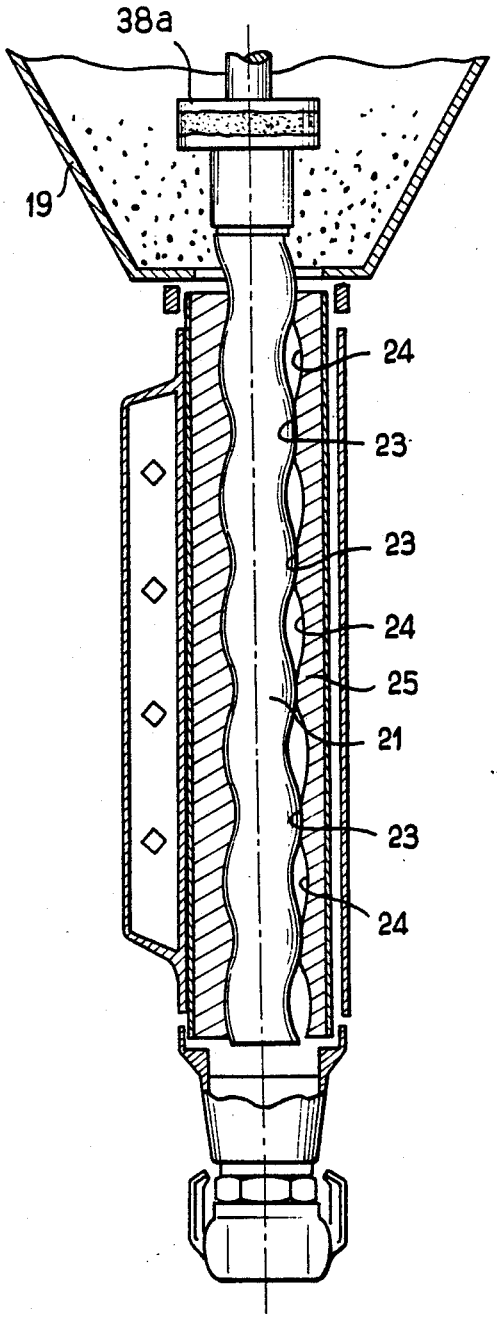
FIG. 2 is a view in longitudinal section of the pump used in the installation in FIG. 1.

In the embodiment in FIG. 1, pump 9 is disposed substantially along the vertical axis of hopper 19. Pump 9 is shown in greater detail in FIG. 2. It comprises a rotor 21 driven in rotation along the aforementioned vertical axis by an electric motor 22 driving a shaft 38b comprising two coupling sleeves 38, 38a and thus acting as a universal joint. Rotor 21 has a number of projections 23 cooperating with cavities 24 formed in a stator 25 in which the rotor 21 rotates. When rotor 21 rotates, the projections 23 therein cooperate with the cavities 24 in stator 25 to define compression chambers having a volume which varies during rotation of the rotor, thus driving the pasty mixture under pressure in pipe system 10.

Figure 3:
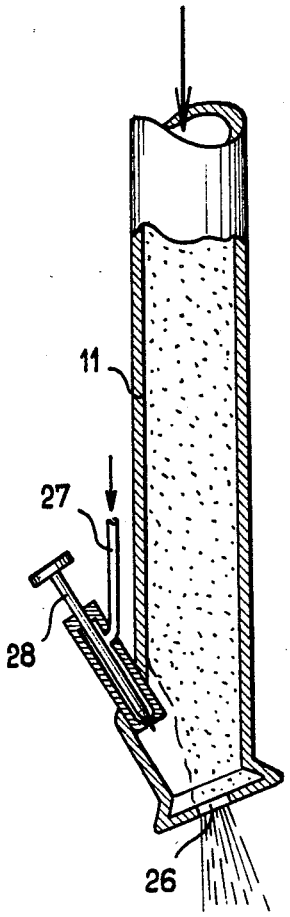
FIG. 3 is a view in partial longitudinal section of the spraying lance in FIG. 1.

The end of pipe system 10 comprises a spray lance 11 shown in detail in FIG. 3.

The end of lance 11 comprises an outlet nozzle 26. A device is provided upstream of the nozzle for introducing compressed air, and comprises an air inlet duct 27 and a needle valve 28 for adjusting the air flow rate.

In the embodiment in FIG. 4, a pump 9a for propelling the pasty mixture formed in tubular members 3, 5 and 3a, 5a and leaving the hopper 9a containing mixing blades 39a, is disposed along a horizontal axis. Water for moistening can be supplied either to the cylindrical members 5, 5a as in FIG. 1 or to the hopper 19a and mixing blades 39a.

The spraying lance 11 disposed at the end of pipe 10 can be carried by a workman. Note that the machine comprises an information system which shows the operator when the first product is applied and when he will be applying the second layer or other layers of different nature. The operator is therefore informed at every moment about what he is doing and the quality of the product which he is spraying.

Preferably the spraying lance 11 is carried and manipulated by a robot 30 as indicated in FIG. 4. In this example, robot 30 is secured to a carriage which can move along a track 32 extending transversely above the casting tundish 1. Track 32 may itself move perpendicularly to its direction along two track surfaces 33 extending on either side of distributor 1.

Robot 30 also has e.g. jointed arms and/or hydraulic jacks 34, 35, 36, 37 for moving the spraying lance 11 inside the tundish 1, in a vertical plane parallel to track 32. By moving the robot 30 along tracks 32, 33 and by moving the arms 34, 35, 36 and 37, lance 11 can spray the pasty material on to any place inside the casting tundish.

Figure 5:
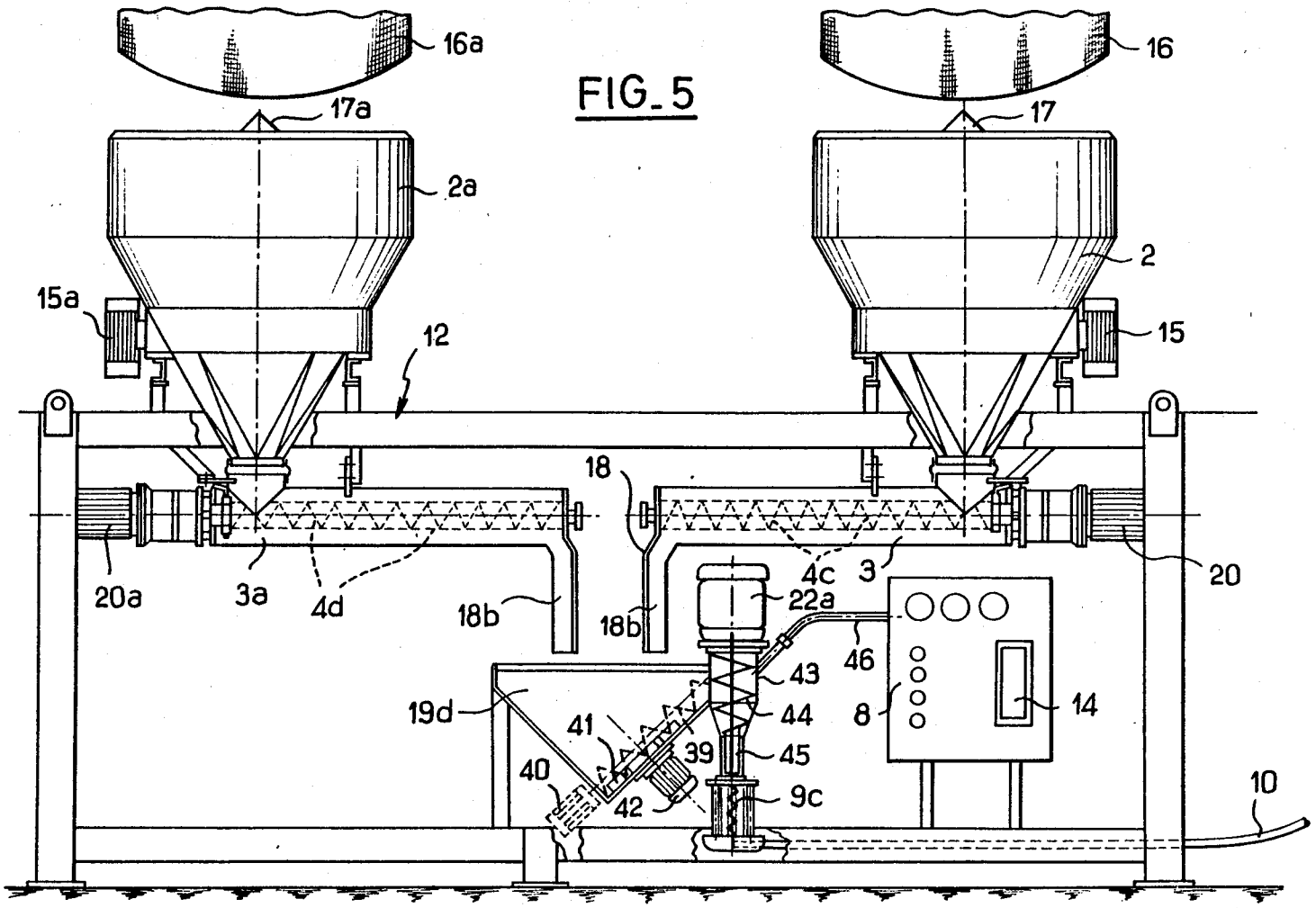
FIG. 5 is a view in elevation of a variant embodiment of an installation according to the invention.

In the embodiment in FIG. 5, the tubular members 3, 3a contain a single spiral conveyor 4c, 4d and at their ends have a chute 18b which opens above a hopper 19d having an inclined or horizontal bottom and comprising e.g. a conveyor belt or a serrated disc 41 driven in rotation by a motor 42, or a spiral conveyor 39 driven by a motor 40, which conveys the dry material to a mixer 43 with a screw 44 driven in rotation by a motor 22a. A pipe system opening into mixer 43 supplies cold or warm water 46 from the metering device 8. A reservoir of warm water can be interposed between the water inlet 46 and the mixer 43 in order to moisten the solid constituents of each of the aforementioned mixtures with warm water at varying temperature.

Mixer 43 has a vertical shaft bearing a screw and/or mixing blades 45 and driving in rotation a pump and screw 9c which drives the pasty material in pipe system 10.

Figure 6:
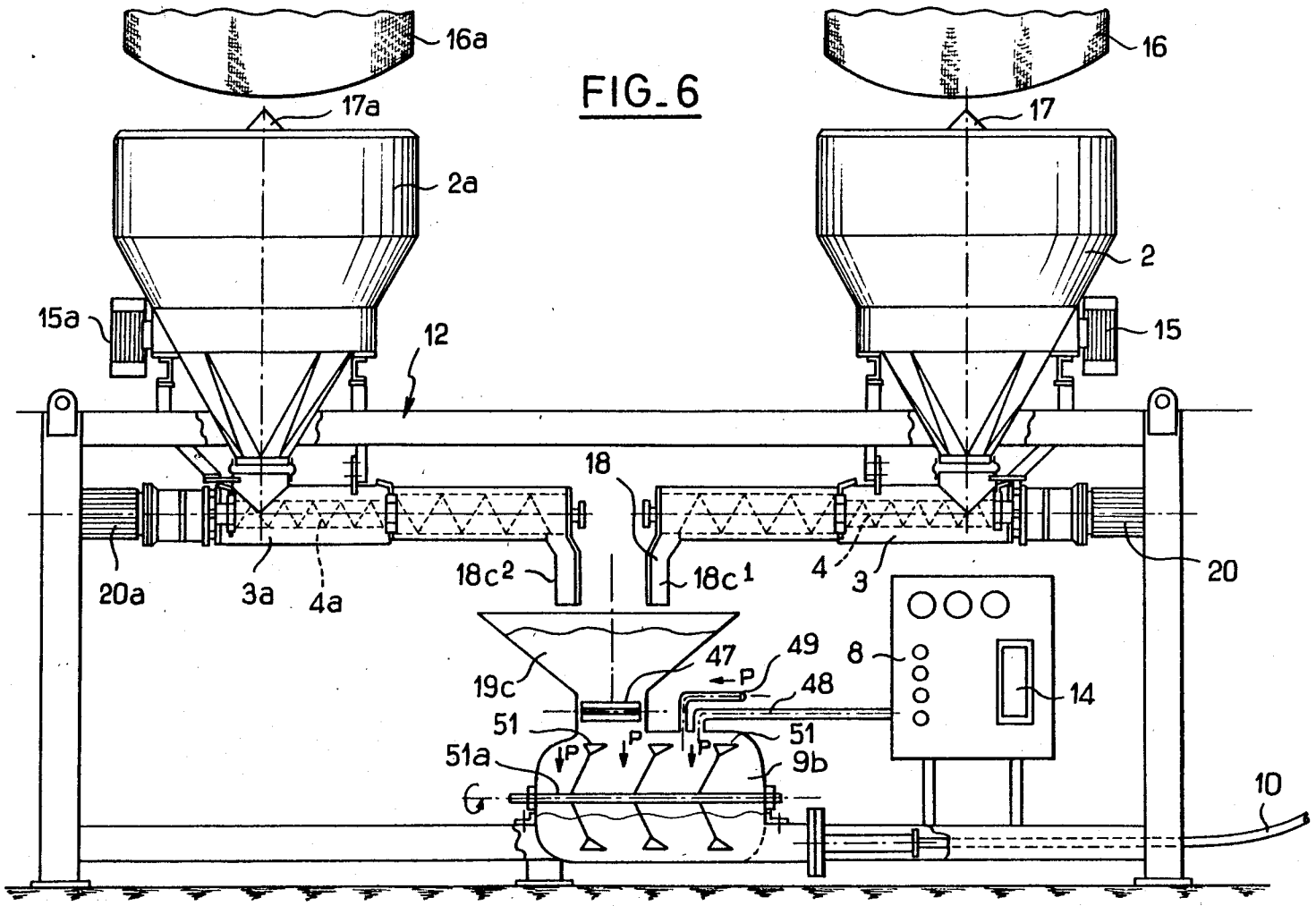
FIG. 6 is a view corresponding to FIG. 5 showing another variant of an installation according to the invention.

In the embodiment in FIG. 6, outlet chutes 18c, and $18c_2$ of the tubular members pour mixed dried material into a hopper 19c surmounting a common mixing tank 9b under pressure, into which a pipe system 48 opens and supplies water from device 8. The mixing tank contains mixing blades 51 driven in rotation around a shaft 51a by a motor (not shown). Hopper 19c is connected to tank 9b by a nonreturn valve or a blade distributor 47. A second duct 49 opening into tank 9b is connected to a source of compressed air. The pressure drives the pasty mixture in tube system 10.

Figure 7:
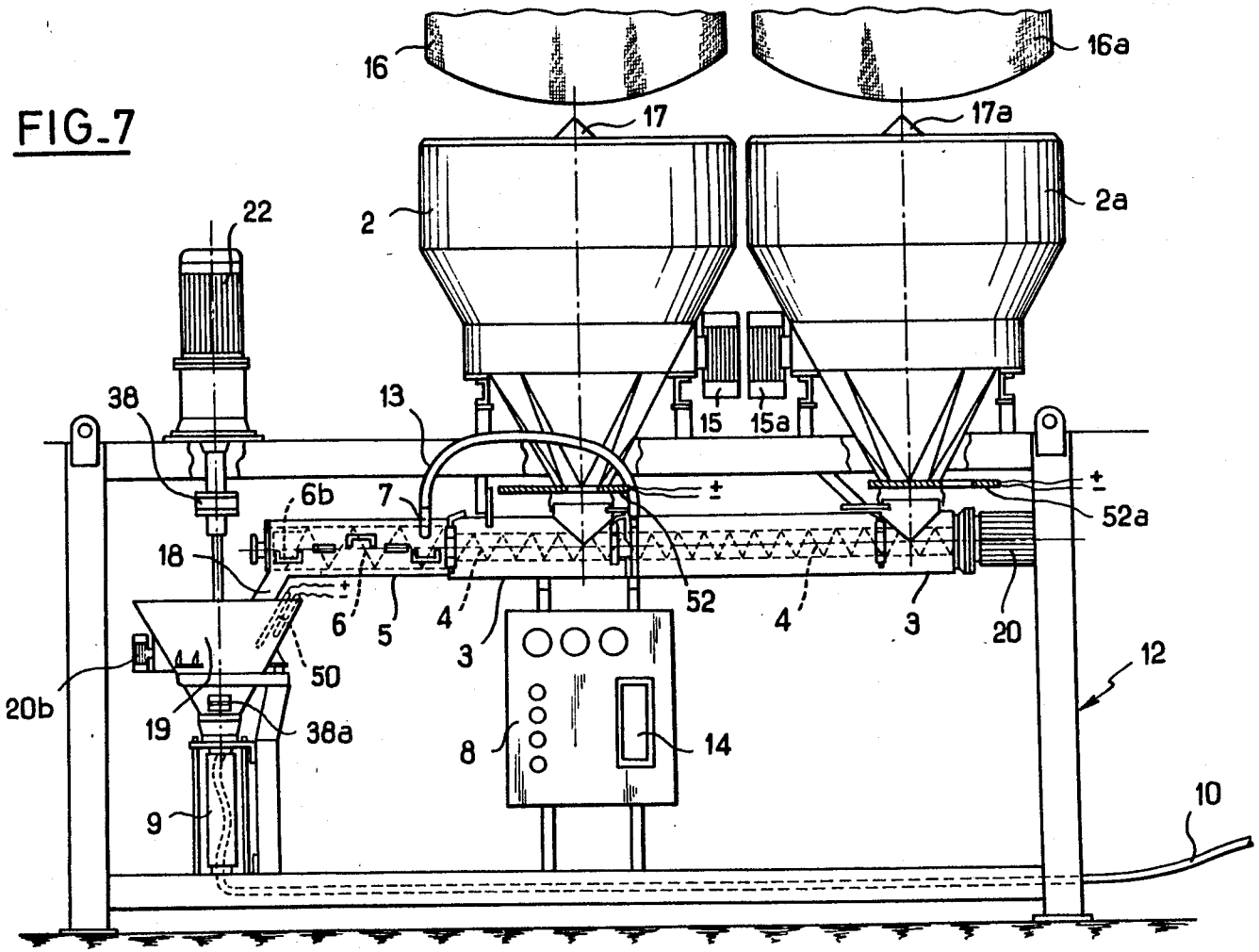
FIG. 7 is a view in elevation of another embodiment of an installation according to the invention.

In the embodiment in FIG. 7, the two hoppers 2, 2a surmount and supply a single first tubular member 3 containing a single metering and mixing spiral conveyor 4. Member 3 is prolonged by a single second tubular member 5 containing a mixing spiral conveyor 6 and/or mixing blades 6b. At the base of each hopper 2, 2a there is an opening and closing device 52, 52a electrically controlled e.g. a solenoid slide valve or a blade distributor, so as to enable or prevent the solid constituent therein from flowing. This arrangement is simpler than that shown in FIG. 1 and, as compared with FIG. 1, dispenses with the assembly comprising the tubular members 3a, 5a, the metering and mixing conveyor 4a, the mixing conveyor 6a or mixing blades 6b, the motor 20a, the water inlet 7a and pipe 13a, and the end 18a. In the system shown in FIG. 7, device 52 is in the position enabling the products in hopper 2 to flow in the cylindrical member 3, and device 52a is in the position preventing the products in hopper 2a from flowing in cylindrical member 3. If required, devices 52 and 52a can open partially and simultaneously for simultaneous flow of the products in hoppers 2, 2a in proportions which can be predetermined.

Figure 8:
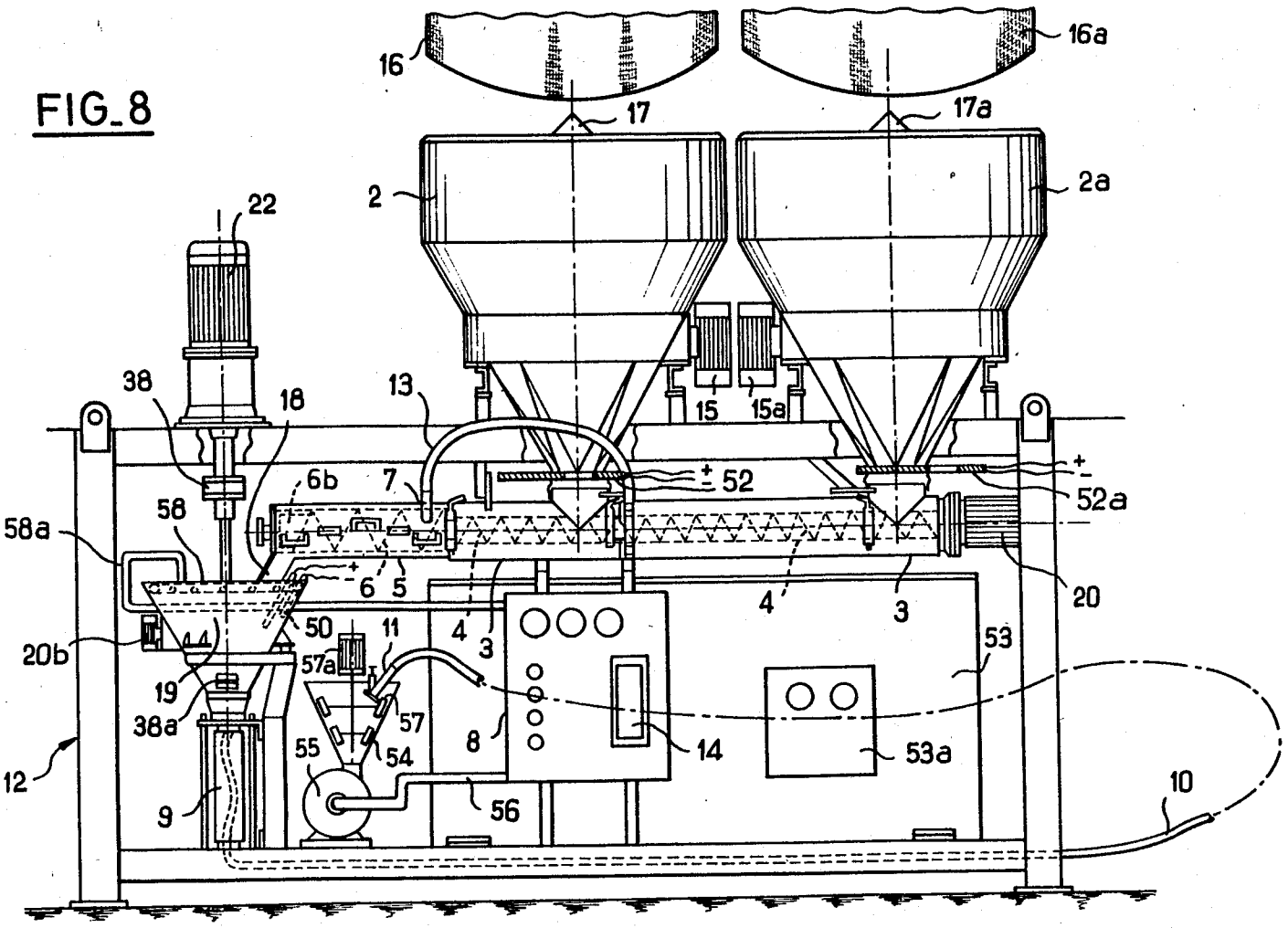
FIG. 8 is a view similar to FIG. 7 of a variant of the installation in FIG. 7.

In the embodiment in FIG. 8, the installation described in FIG. 7 also comprises a warm water reservoir 53 disposed inside a metal frame 12 under the tubular members 3 and 5. Reservoir 53 is connected to a source of cold water (not shown) and the water metering device 8. It comprises heating means (not shown) for heating the water therein and keeping it warm, and a control cabinet 53a for the heating means. The water is warmed to a predetermined temperature allowing for the operating conditions of the installation, more particularly for the temperature in the workshop and the temperature of the solid constituents of the various layers coming from bags 16, 16a above hoppers 17, 17a.

The installation shown in FIG. 8 also comprises a device for rinsing, after use, the equipment receiving and conveying the pasty aqueous mixtures, collecting the rinsing sludges and re-using the sludges for preparing pasty aqueous mixtures for the next operation. To this end, a duct 58 is disposed along the inner perimeter of the upper part of hopper 19 and is connected by a duct 58a to device 8. Duct 58 is formed with a number of holes which, when duct 58 is full of water, give rise to a number of water jets directed towards the sides of hopper 19. A hopper 54 for collecting rinsing sludges is also disposed e.g. inside frame 12. Hopper 54 contains blades 57 driven by a motor 57a. The bottom part of hopper 54 is connected to a pump 55 driven by a motor (not shown). Pump 55 is connected to device 8 by a duct 56 by means of which the sludges in hopper 54 can be injected into the water circuit upstream of the flow meter 14, so that the sludges can be used instead of water to prepare pasty aqueous mixture for the next operation.

Figure 9:
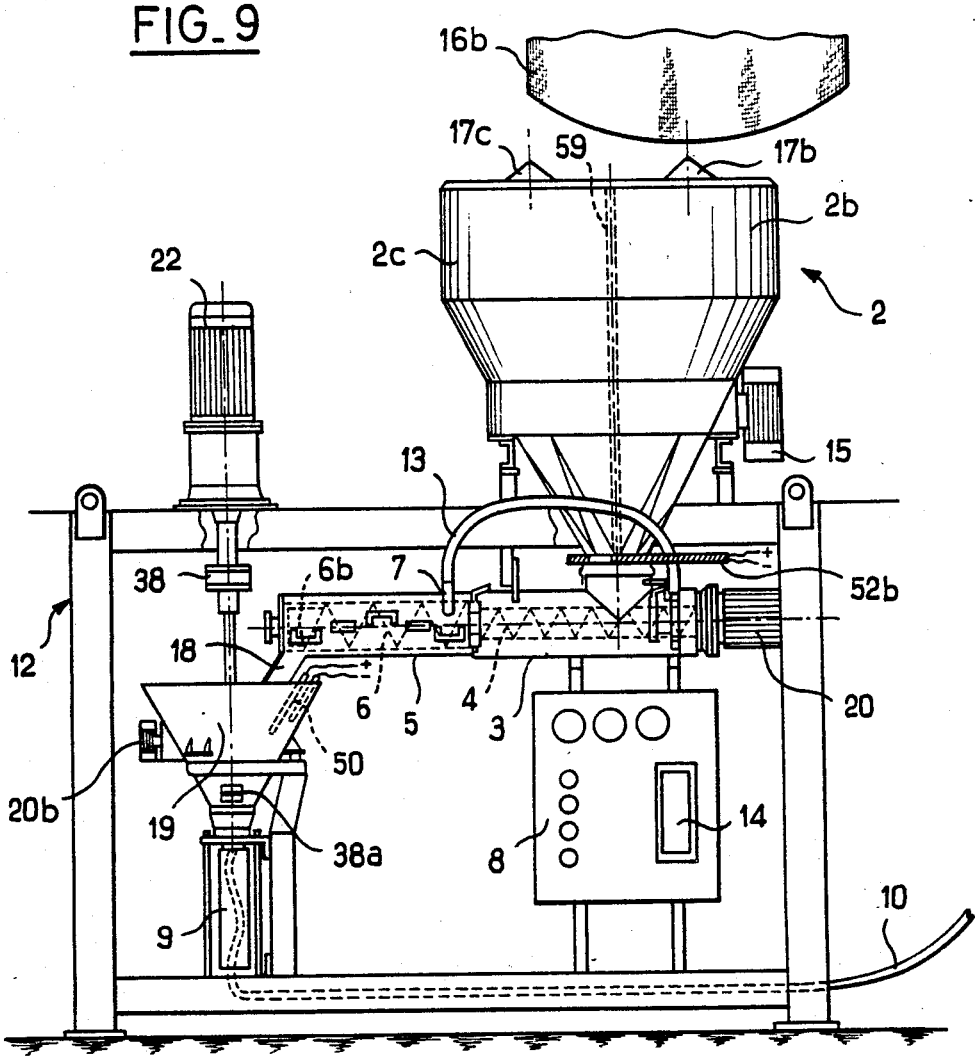
FIG. 9 is a view in elevation of another embodiment of the installation according to the invention.

In the embodiment in FIG. 9, the installation is similar to FIG. 7 but comprises only one hopper 2 divided e.g. into at least two hopper parts **2*b*, 2*c* by a central partition 59. Each hopper part 2*b*, 2*c* can be equipped with a cone 17*b*, 17*c* respectively for piercing bags such as 16*b* supplying the solid constituents of the various layers. At the bottom of hopper 2 there is an opening and closing device 52*b* which can be electrically controlled and is adapted to enable or prevent the solid constituents in each hopper part 2*b*, 2*c* from flowing in the cylindrical member 3. Alternatively, the device can be adapted to occupy one or more intermediate positions enabling the solid constituents in the two hopper parts to flow simultaneously in variable proportions which can be predetermined. In the arrangement shown in FIG. 9, device 52*b* is in the position enabling the products in hopper part 2*c* to flow and preventing the products in hopper part 2*b*** from flowing.

The installation described with reference to FIG. 1 operates as follows:

The mixtures of solid materials from bags **16, 16*a* or from other silos are introduced into hoppers 2, 2*a***, corresponding to the two layers which are to be formed.

Vibrator 15 and motor 20 driving the conveyors 4 and 6 and/or **6*b* are e.g. started. The material first enters the tubular member 3 where it is metered by conveyor 4. The metered mixture is then driven into the tubular mixing member 5, into which water is injected at a regulated flow rate and pressure in order to obtain a pasty mixture having the desired consistency at the outlet 18**.

The pasty mixture is continuously introduced into hopper 19, which is equipped with a vibrator or vibrating needles **20*b* and supplies pump 9** by gravity.

Pump 9 drives the pasty mixture into the flexible pipe 10. The mixture is sprayed inside the tundish 1 by lance 11.

The composition of the sprayed material when in dry form is e.g. as follows:

Mineral binder (e.g. boron and/or boric acid and/or clay and/or silicate and/or aluminous and/or Portland and/or phosphate and/or magnesia and/or organic cement (e.g. synthetic adhesive) . . . 0 to 100%

Refractory inorganic particles in the form of grains and/or fibres (e.g. chromium magnesia and/or magnesia and/or magnesia silicate and/or silica and/or alumina and/or zirconium dioxide and/or zircon and/or lime: 0 to 100%

Inorganic particles and/or carbonaceous material in the form of fibres and/or grains: 0 to 30%

Surfactant compounds: 0 to 5%

In this manner, a first layer of the composition can be continuously applied to the interior of the casting tundish.

In order to cover the first layer with a second layer of different composition and different water content if required, it is only necessary to stop the motor 20 which drives conveyors 4 and 6 in rotation and to start the motor **20*a* which drives conveyors 4*a* and 6*a*. Pump 9 is then supplied with a pasty mixture obtained from the solid constituents in bag 16*a***.

At the end of the operation, it is only necessary to send water into tubular members 5 and **5*a*** in order to remove any pasty material remaining inside the various parts of the installation and prevent the material from hardening and block them.

The embodiments in FIGS. 4, 5 and 6 operate in identical manner except as regards the supply of water for moistening the various solid mixtures. In the embodiment in FIG. 4, water can be supplied to the tubular members **5, 5*a* as in the embodiment in FIG. 1; in that case, hopper 19*a* and blades 39*a* can be used for additional mixing. If motors 20, 20*a* are variable-speed motors or equipped with speed variators, the installation shown in FIG. 4 can spray either the constituent in hopper 2 by itself, or the constituent in hopper 2*a* by itself, or a mixture or a number of different mixtures of these constituents by simultaneously operating the conveyors 4, 4*a* in members 3, 3*a*** at respective speeds set so as to obtain the desired mixture or various mixtures.

The same applies to the embodiments shown in FIGS. 5 and 6, in which water is supplied to mixer 43 and tank **9*b* respectively. The embodiment in FIG. 5 is particularly suited for continuous operation, whereas the embodiment in FIG. 6 is more suited for discontinuous but very flexible operation, spraying having to be interrupted whenever tank 9*b* has to be filled by opening the valve closure-type device 47 for supplying tank 9*b* with the constituents retained in hopper 19*c*, except of course if device 47 is a blade distributor. Once the constituents are in tank 9*b*, the tank is supplied through duct 48 with the quantity of water necessary for giving the mixture the desired consistency. The mixing blades 51 can be permanently actuated or stopped when tank 9*b* is filled. When the mixture is ready, the tank is pressurized with compressed air supplied by 49**. Operation is therefore discontinuous, but the composition of the mixture can be very accurately modified if required at each new filling.

In the embodiment shown in FIG. 7, a first layer corresponding to the constituent e.g. in hopper 2 is produced by opening the device 52 and keeping the device **52*a* on hopper 2*a* closed. In order to apply a second layer of different composition corresponding to the constituent in hopper 2*a*, it is only necessary to close device 52, to open device 52*a* and to adjust the water flow rate as necessary. Alternatively, of course, both devices 52, 52*a* can be partially opened simultaneously to obtain any mixture of the two constituents in hoppers 2 and 2*a*** respectively.

In the embodiment in FIG. 8, warm water can be used instead of cold water, but this makes absolutely no difference to the manner of operation which is as described hereinbefore in the case of the embodiment in FIG. 7.

When the installation is stopped for the time needed to clean the equipment receiving and conveying the pasty aqueous products, the tubular member 5 is cleaned as in the embodiments in FIGS. 1, 4 and 7, by keeping up the supply of water at 7 through duct 13 and stopping the extraction of solid constituents. Next, duct 58 is supplied with water coming from device 8 via duct **58*a*, thus producing numerous jets of water which clean the sides of hopper 19. Pump 9 is kept in operation and the spray nozzle 11 mounted at the end of tube 10 is placed above hopper 54 in order to recover and collect the rinsing sludges therein. Care is taken to ensure that the rinsing sludges are very liquid. When rinsing is complete, the installation and pump 9 are stopped and motor 57***a* is started and drives the mixing blades 57 so as to keep the sludges in liquid form. When operations restart, pump 55 is started up so as to inject the very liquid sludges through duct 56, device 8 and duct 13 and via the water inlet 7 into the tubular member 5, instead of water. The water metering device 8 adjusts the supply of highly liquid sludges to the required flow rate, just as when water is used. This avoids wastage of the products remaining in members 5, 19, 9 and 10 at the end of the preceding operation.

It is therefore clear that the method and installation according to the invention can be used under excellent technical and economic conditions and without interruption, as already pointed out, to produce the two layers of different composition described inter alia in French patent application No. 2 585 273 in the name of the Applicants.

A first possibility is to produce the two layers by the method and installation according to the invention on the permanent refractory coating of the metallurgical vessel, which is often made of refractory bricks as diagrammatically indicated in FIG. 4.

It is also known e.g. to insert an insulating material between the outer metal casing of a metallurgical vessel, such as the continuous casting tundish 1 shown in FIG. 1, and the permanent refractory lining thereof, thus greatly reducing gradual deformation of the metal casing by heat.

Figure 10:
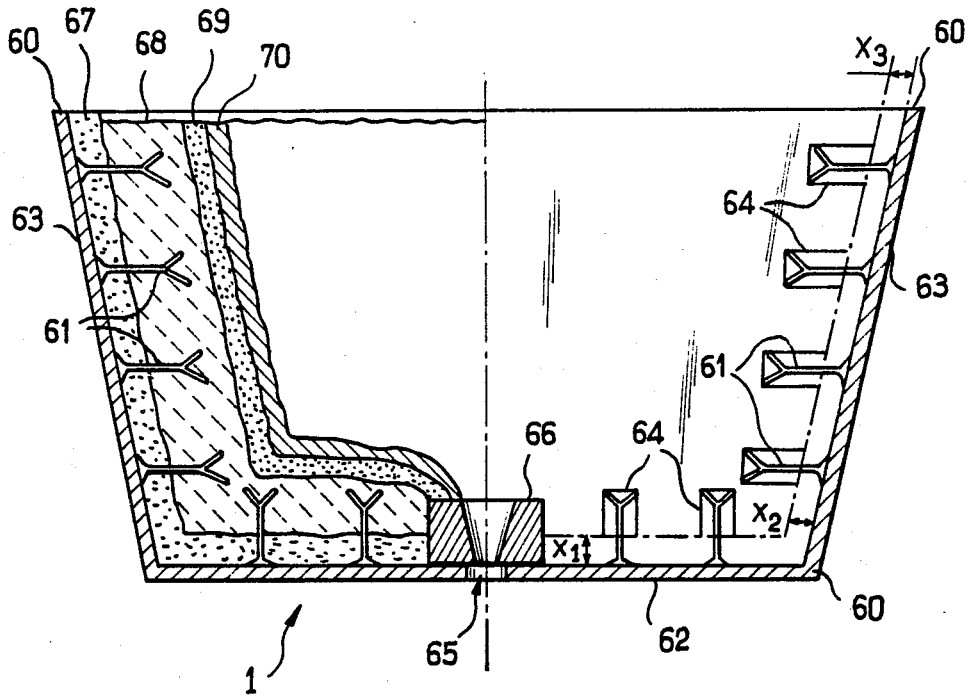
FIG. 10 is a view in cross-section of a continuous casting tundish showing an example of a refractory insulating multilayer coating according to the invention.

We thus arrive at another advantageous possibility, for which the conditions and results in operation are shown in FIG. 10.

FIG. 10 is a view in cross-section of a continuous casting tundish 1. The right half of the drawing shows the outer metal casing 60 of the tundish. A number of metal anchoring rods 61 are welded to the inner surface of the base 62 and sides 63 of tundish 1. Each rod 61 is covered by a cap 64, the purpose of which will be specified hereinafter. The base 67 of the tundish is formed with at least one hole 65 for casting liquid metal, and a seating brick 66 is placed above each hole 65.

Using the method and installation according to the invention, four layers are successively deposited on the inner surface of the base 62 and sides 63 of tundish 1 as shown on the left half of FIG. 10, i.e.:

A permanent insulating layer 67 for thermally insulating the metal casing 60 of tundish 1 in order greatly to reduce deformation thereof by heat;

A permanent refractory layer 68, and

The two refractory insulating layers 69, 70 of different composition described inter alia in the aforementioned French application No. 2 585 273.

The anchoring rods 61 are for firmly anchoring the permanent layers 67, 68 to the base 62 and sides 63 of tundish 1, which can therefore be inverted so that after use the wearing layers 69, 70 fall out and are replaced according to the invention.

Accordingly, the first insulating layer 67 is sprayed by the method and installation according to the invention. The layer can advantageously have the following composition:

binder (e.g. cement): 95% to 40% inorganic grains such as: Perlite and/or vercimulite and/or mineral silica and/or calcium silicate and/or alumina and/or silica and/or magnesia: 5% to 50% clay: 0% to 10% and organic and/or inorganic fibres: 0% to 10%

The caps 64 prevent the heads of the anchoring rods 61, which have a carp's tail shape in the embodiment shown, from becoming covered by the material from layer 67 when the layer is formed. Caps 64 also enable an operator to adjust the thickness X1, X2, X3 to be given to layer 67 at various places on the distributor.

After depositing the first layer 67, the permanent refractory layer 68, which is a refractory concrete known per se, is deposited by spraying, as before by using the method and installation according to the invention. Layer 68 can be sprayed immediately after layer 67, after removing the caps 64.

The refractory concrete layer 68 is preferably left to dry and set before producing the two refractory insulating layers 69 and 70, but the four layers 67, 68, 69, 70 could be sprayed one after the other without interruption or almost without interruption if necessary, provided the constituents of the adjacent layers 68, 69 are compatible. Use can then be made of an installation according to the invention comprising four hoppers or parts of hoppers each containing the respective solid constituent of one of the layers 67 to 70, or an installation containing two hoppers or parts of hoppers can be used and emptied after spraying the layers 69 and 70.

Of course, the invention is not limited to the examples described hereinbefore, which can undergo numerous modifications without departing from the scope of the invention.

For example, three layers of different compositions can be provided, with three hoppers containing three different constituents, or two hoppers containing two different constituents to be sprayed either alone or mixed with one another in variable proportions; the two or three hoppers can each be equipped with at least one metering and mixing conveyor according to any of the embodiments shown in FIGS. 1, 4, 5 and 6 or can each be provided with an opening and closing device 52 and be served by a single metering and mixing conveyor 4 as per one of the embodiments shown in FIGS. 7 and 8. Alternatively, hoppers and/or parts of hoppers can be associated by combining the embodiments in FIGS. 7 and 8.

Likewise, each embodiment shown in FIGS. 1, 4, 5, 6, and 9 can be equipped with a warm water reservoir 53 provided with corresponding heating and control means, and/or a device for collecting and reusing the rinsing sludges.

The metering and mixing conveyors, the mixing conveyors or blades, and the pumps as described can be replaced by equivalent equipment.

The vibrators 15, 15*a*, 20*b* in hoppers 2, 2*a*, 19 can be replaced by other means for assisting the flow of pulverulent material, e.g. by vibrating needles.

Finally, a number of devices described in various embodiments of the invention can be combined with other devices necessary for preparing each of the constituents of the various mixtures in satisfactory manner in the installation, starting from the raw materials or mixtures of the raw materials. More particularly, the intermediate hopper 19*d* can be supplied with solid constituents by a conveyor belt or by pneumatic means. Likewise, the hopper 19 in FIG. 1 can be equipped with mixing blades identical with the blades 57 equipping the hopper 54 for collecting the rinsing sludges and shown in FIG. 8, the blades being directly mounted on the driving shaft 38*b* of rotor 21 of pump 9. The blades will help the pump 9 to supply a pasty mixture which flows from hopper 19 into pump 9 by gravity or by the action of the vibrator or needles 20*b*.

Alternatively, to give maximum flexibility to the installation in use, each hopper or part of a hopper can be equipped with a rapid-emptying device, e.g. by reversing the direction of rotation of conveyors 4 and recovering the solid constituent in a hopper and/or in bags, thus rapidly changing the solid constituent for spraying.

We claim:

1. In a method of applying an insulating refractory coating made up of at least two layers to interior surfaces of metallurgical vessels (1) in which at least two different aqueous pasty hardenable products each prepared by mixing with water a respective set of grainy, pulverulent or fibrous constituents or mixtures thereof are successively applied in successive layers to said surfaces; the improvement in which for each successive layer of different product, the respective aqueous pasty hardenable product is prepared as a ready-for-use mixture by mixing with water said respective set of grainy, pulverulent or fibrous constituents or mixtures thereof, then is pumped and supplied to a single means (11) for spraying onto the surface to be coated.

2. A method according to claim 1, in which for each layer, a respective set of solid constituents for forming said layer is successively introduced into a tubular member (3, 3*a*) containing a spiral conveyor (4, 4*a*) after which the set of constituents is successively and continuously fed to a tubular member (5, 5*a*) containing a rotating mixing and conveying means (6, 6*a*; 6*b*) into which a predetermined amount of water is continuously introduced (at 7, 7*a*; 19*a*) by a water metering device (14) in order to obtain a pasty consistency for each layer, resulting pasty mixtures are then successively fed by gravity to a common single pump means (9, 9*a*; 9*b*) and are then successively fed to a single pipe system (10) at the end of which the various pasty mixtures are successively sprayed under pressure through the same lance (11) onto the surface to be coated.

3. A method according to claim 2, in which the common single pump means is a mixing tank (9*b*) under pressure and the mixing tank (9*b*) is supplied with water through a duct (48) coming from the water metering device (14) in order to obtain a pasty consistency for each of the mixtures when the solid constituents of each mixture are not mixed and moistened via the tubular members (3, 3*a*; 5, 5*a*) comprising the spiral conveyors (4, 4*a*) and the rotating mixing and conveying means (6, 6*a*) in which water is introduced (at 7, 7*a*) but are only conveyed dry in the tubular members (3, 3*a*).

4. A method according to claim 2, in which compressed air is supplied to the tank (9*b*) by a duct (49).

5. A method according to claim 1, in which for each layer, a respective set of solid constituents for forming said layer is successively introduced into a tubular member (3, 3*a*) containing a spiral conveyor (4*c*, 4*d*) after which the set of constituents is successively and continuously fed to a hopper (19*d*) equipped with rotary means (39, 41) for supplying pulverulent constituents to a tubular member (43) disposed substantially vertically and containing a spiral conveyor (44) into which a premetered water inlet (46) opens, the conveyor (49) being prolonged by mixing means (45) which in turn is prolonged by a screw pump (9*c*), the assembly being driven by a motor (22*a*) and the pump successively pushing the resulting pasty mixtures under pressure into a single pipe system (10), at the end of which the various pasty mixtures are successively sprayed under pressure through said same lance (11) onto the surface to be coated.

6. A method according to claim 5, in which the pulverulent constituents are successively and continuously fed to a hopper (19*d*) by conveyor means.

7. A method according to claim 1, in which water is previously warmed to obtain a pasty consistency for each layer.

8. A method according to claim 1, in which at the end of the method, the equipment (19, 9, 10, 11) receiving and conveying the pasty aqueous products is rinsed with water, thereby producing rinsing sludges which are recovered and used in the subsequent operation to obtain the desired pasty consistency for each layer.

9. A method according to claim 1, in which at least four layers are successively applied to the surface to be coated, said layers comprising at least one first permanent insulating layer followed by at least one permanent refractory layer and finally by at least two refractory insulating layers.

10. In an installation for applying an insulating refractory coating comprising at least two layers onto interior surfaces of metallurgical vessel (1), in which at least two different aqueous pasty hardenable products each prepared by mixing with water a respective set of grainy, pulverulent or fibrous constituents or mixtures thereof are successively applied in successive layers to said surfaces by the installation; the improvement in which the installation comprises first and second pairs of tubular members (3, 5; 3*a*, 5*a*) each containing a respective metering spiral conveyor (4, 4*a*) and a rotating mixing and conveying means, and means for supplying each pair of tubular members (3, 5; 3*a*, 5*a*) with the solid constituents of each layer to be formed, said second tubular members (5, 5*a*) each comprising a water inlet (7, 7*a*) connected to means (8) for continuously supplying the tubular members with a quantity of water necessary to obtain a pasty consistency for each layer, and means for feeding a resulting aqueous pasty hardenable mixture coming from the two tubular members (3, 5) in the first pair or from the other two tubular members (3*a*, 5*a*) to a pump (9) connected to a single pipe system (10) for spraying the mixture.

11. An installation according to claim 10, in which for each layer the spiral conveyor (4, 4*a*) and the rotating mixing and conveying means (6, 6*a*; 6*b*) are mounted on a substantially horizontal axis.

12. An installation according to claim 10, in which each tubular member (5, 5*a*) containing the rotating mixing and conveying means (6, 6*a*; 6*b*) is connected to a cabinet (8) containing means (14) for adjusting the pressure and flow rate of water.

13. An installation according to claim 10, in which each tubular member (3, 3*a*) containing the metering and mixing spiral conveyor is surmounted by a hopper (2, 2*a*) for introducing the solid constituents of the mixture and comprising means (15, 15*a*) for facilitating the flow of mixture in the tubular member.

14. An installation according to claim 10, in which an end (18, 18*a*) of each tubular member (5, 5*a*) containing said rotating mixing and conveying means (6, 6*a*; 6*b*) opens above a single hopper (19) for introducing the pasty mixture into the pump (9).

15. An installation according to claim 13, in which the flow-facilitating means comprise a vibrating means (15, 15*a*, 20*b*) associated with each hopper (2, 2*a*, 19).

16. An installation according to claim 1, in which the two spiral conveyors (4, 4*a*) and the rotating mixing and conveying means (6, 6*a*; 6*b*) are mounted on a same shaft and are driven in rotation by a same motor (20, 20*a*).

17. An installation according to claim 1, in which the rotating mixing and conveying means (6, 6*a*; 6*b*) mounted in each tubular member (5, 5*a*) comprising the water inlet (7, 7*a*) has a large pitch and diameter than the spiral conveyor (4, 4*a*) mounted in the other tubular member (3, 3*a*) supplied with the solid constituents.

18. An installation according to claim 1, in which the pump (9) is disposed substantially along a vertical axis of the hopper (19).

19. An installation according to claim 1, in which an axis of the pump (9*a*) is substantially horizontal.

20. An installation according to claim 14, which also comprises a warm water reservoir (53) provided with means for warming the water and a control cabinet (53*a*) for said warming means.

21. An installation according to claim 1, which also comprises means (58) for rinsing, after use, equipment (19, 9, 10, 11) receiving and conveying the pasty aqueous mixtures, means (54) for collecting and storing the rinsing liquids, and means (55, 56) for recovering said rinsing liquids and using them during a subsequent operation of preparing the pasty aqueous mixtures.

22. An installation according to claim 1, in which said second tubular members are combined in a single substantially tubular second member (5, 43, 9*b*) comprising a water inlet (7, 46, 48) and means (6, 6*b*, 44, 51) for mixing the aqueous pasty mixtures.

23. An installation according to claim 22, in which the two first tubular members (3, 3*a*) are combined into a single first tubular member (3) which serves the hopper means (2, 2*a*; 2*b*, 2*c*) containing the solid constituents of each layer to be formed, and which contains a metering and mixing spiral conveyor (4) and each hopper means (2, 2*a*; 2*b*, 2*c*) containing the various solid constituents of each layer to be formed having means (52, 52*a*; 52*b*) enabling or preventing a solid constituent therein from flowing.

24. An installation according to claim 22, said first tubular members (3, 3*a*) being separate from one another, and upstream of said single second substantially tubular member (43, 9*b*), an intermediate hopper (19*d*, 19*c*) having means for evacuation of the constituents of each layer to be formed.

25. An installation according to claim 24, in which said single second substantially tubular member (43, 9*b*) comprises means forming a pump (9*c*, 49).

* * * * *